US005486682A

United States Patent [19]

Rysemus

[11] Patent Number: 5,486,682

[45] Date of Patent: Jan. 23, 1996

[54] HEATER ASSEMBLY FOR SWAGED CARTRIDGE HEATER AND METHOD OF MANUFACTURE

[75] Inventor: Robert A. Rysemus, Buffalo Grove, Ill.

[73] Assignee: Acra Electric Corporation, Schiller Park, Ill.

[21] Appl. No.: 964,278

[22] Filed: Oct. 21, 1992

[51] Int. Cl.[6] ..... H05B 3/00

[52] U.S. Cl. ..... 219/544; 219/542; 338/240; 338/301; 29/615; 29/611

[58] Field of Search ..... 219/544, 541, 219/552, 542; 338/240, 238, 239, 241, 242, 274, 315, 297, 301; 29/611, 613, 615, 616

[56] References Cited

U.S. PATENT DOCUMENTS

| | | | |
|---|---|---|---|
| 1,523,434 | 1/1925 | Lightfoot et al. | 338/240 |
| 3,080,543 | 3/1963 | Boggs | 338/240 |
| 3,252,122 | 5/1966 | Baxter | 338/240 |
| 3,582,616 | 6/1971 | Wrob | 219/541 |
| 3,812,580 | 5/1974 | Drugmand | 29/611 |
| 3,821,517 | 6/1974 | Erickson | 338/301 |
| 3,881,163 | 4/1975 | Lindroth et al. | 219/541 |
| 4,314,401 | 2/1982 | Saku | 29/611 |
| 4,763,102 | 8/1988 | Ritt | 338/240 |

*Primary Examiner*—John A. Jeffrey
*Attorney, Agent, or Firm*—Wood, Phillips, Van Santen, Clark & Mortimer

[57] ABSTRACT

A cartridge heater assembly to be swaged has a sheath with head and slug ends. A resistance heater unit in the sheath includes a flat rectangular core, a resistance wire winding on the core, and first and second core covers, one on each side. Each end of the resistance wire extends from the core through a hole in the adjacent core cover and to the head end of the sheath. Crushable heater unit centralizers at each end of the sheath hold the resistance heater unit. Leads are connected to the ends of the heater wire and the connections are enclosed in the centralizer. A plastic bushing closes the head end of the sheath and a slug closes the slug end of the sheath. The heater assembly is filled with an insulating material and swaged, crushing the centralizers.

7 Claims, 2 Drawing Sheets

Fig. 1
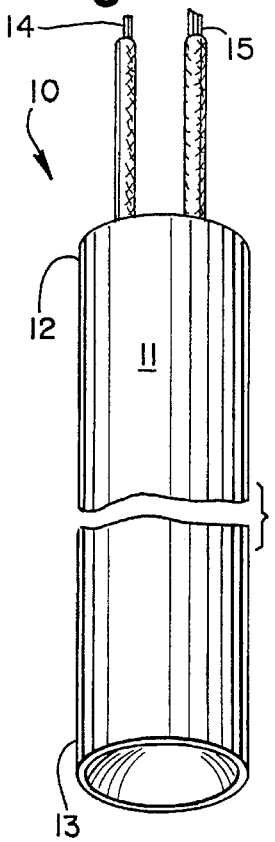
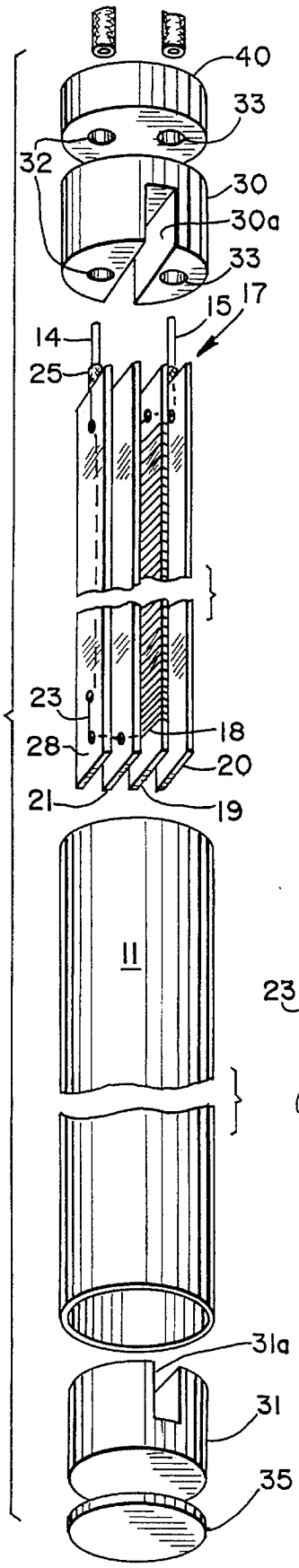
Fig. 2
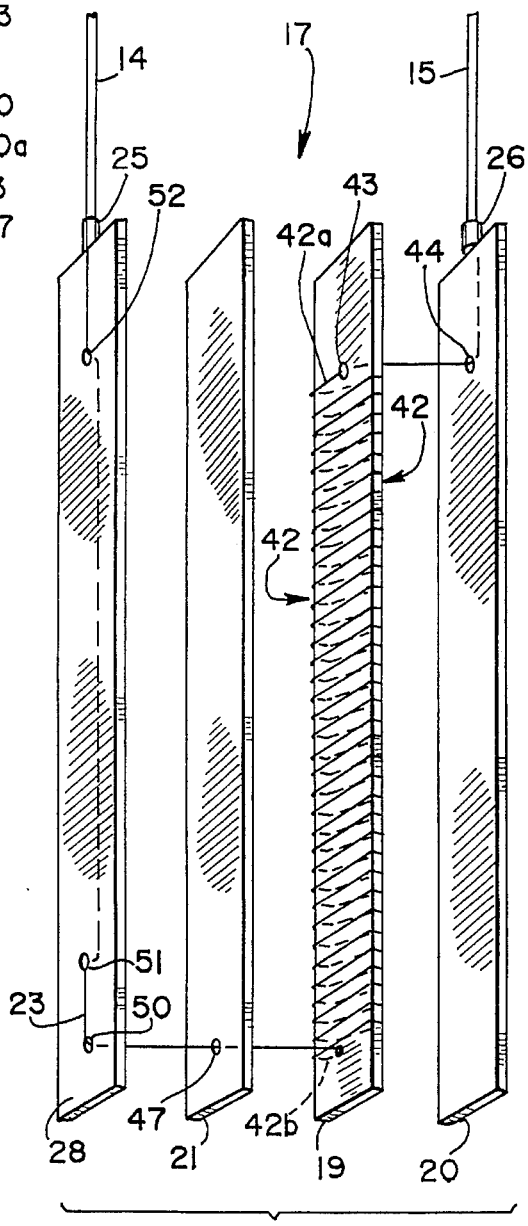
Fig. 3

Fig. 4
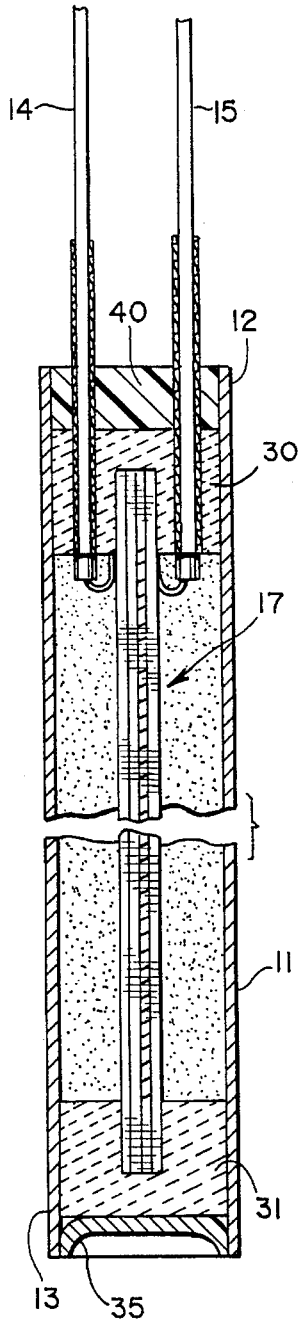
Fig. 5
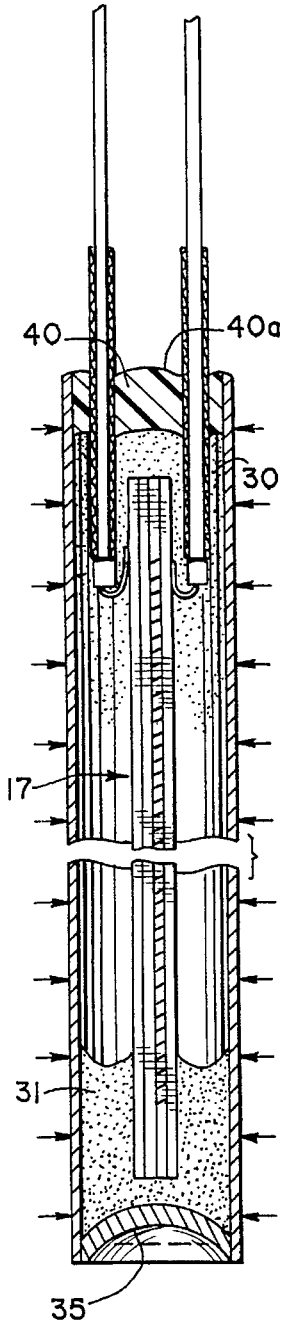
Fig. 6
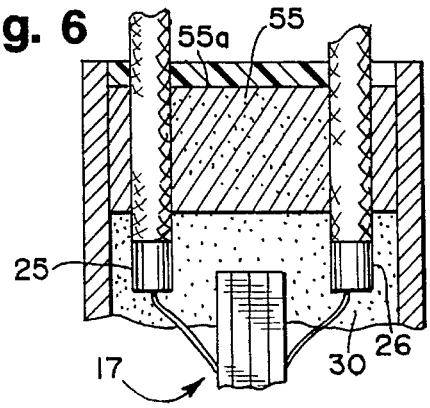
Fig. 7
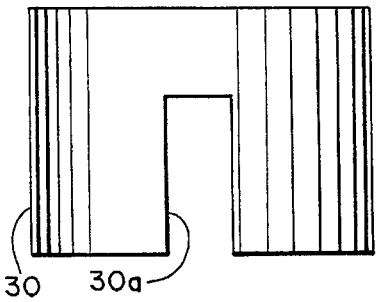
Fig. 8
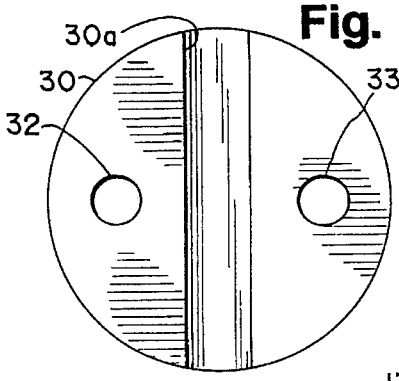
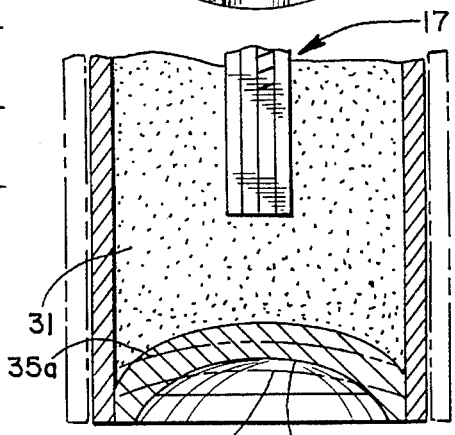
Fig. 9

HEATER ASSEMBLY FOR SWAGED CARTRIDGE HEATER AND METHOD OF MANUFACTURE

FIELD OF INVENTION

This invention relates to a swaged electrical cartridge heater, an assembly from which the heater is manufactured and the method of manufacture.

BACKGROUND OF THE INVENTION

Ritt U.S. Pat. No. 4,763,102 discloses a cartridge heater with a resistance wire heating element wound on a flat, rectangular core of insulating material as a mica splitting or mica paper. The heating element is fitted in a cylindrical sheath which may, for example, be of stainless steel or brass. The heating element and core are positioned in the sheath by bushings or centralizers at either end. The ends of the core are received in complimentary opposed slots in the bushings. The sheath is filled with a granular insulating material as magnesium oxide.

This application is concerned with an improved heater assembly for a swaged cartridge heater and with the method of manufacture of the heater assembly. The granular insulation of a swaged cartridge heater is compacted, affording a higher wattage and temperature rating for the heater.

SUMMARY OF THE INVENTION

A principal feature of the invention is a cartridge heater assembly to be swaged which includes a cylindrical sheath having a head end and a slug end, a resistance heater unit in the sheath, crushable heater unit centralizers at each end of the sheath, holding the resistance heater unit, a plastic bushing closing the head end of the sheath and a slug closing the slug end of the sheath. Another feature is that the slug is dished, as with a convex surface facing the slug end centralizer.

A further feature is that the heater unit has a flat rectangular core of insulating material with a resistance wire winding on the core and first and second flat, rectangular core covers of insulating material, one on each side of the core. More particularly, the resistance wire extends through holes in the adjacent core covers, holding the heater unit together. The resistance wire return extends from the slug end to the head end outside the second cover. Preferably, a third cover is located outside the heater wire return.

Yet another feature of the invention is the method of manufacturing a swaged cartridge heater comprising fabricating a cartridge heater assembly including a cylindrical sheath, a resistance heater unit in the sheath, crushable heater unit centralizers, one at each end of the heater unit and supporting the heater unit in the sheath, and a plastic bushing outside the centralizer at the head end of the sheath, filling the sheath with granular insulation, closing the slug end of the sheath with a slug and swaging the sheath, reducing its diameter and crushing the centralizers. The method includes the further steps of removing the plastic bushing and sealing the head end of the sheath, as with cement.

BRIEF DESCRIPTION OF THE DRAWINGS

FIG. 1 is an elevation illustrating a cartridge heater according to the present invention;

FIG. 2 is an exploded view of the cartridge heater assembly;

FIG. 3 is an exploded view of the heater unit;

FIG. 4 is a longitudinal section of the cartridge heater before swaging;

FIG. 5 is a longitudinal section of the cartridge heater after swaging;

FIG. 6 is an enlarged fragmentary section of the head end of the heater with the plastic seal replaced by cement;

FIG. 7 is an elevation of a centralizer;

FIG. 8 is an end view of a centralizer; and

FIG. 9 is a fragmentary enlarged section of the slug end of the heater showing the slug before and after swaging.

A cartridge heater 10 is shown in FIG. 1 having a cylindrical sheath 11 with head and slug ends 12 and 13, respectively. Sheath 11 is of a suitable material as stainless steel or brass. Leads 14, 15 extend from sheath 11 for connection with an electrical power circuit.

The internal construction of the cartridge heater, prior to swaging, is illustrated in exploded form in FIG. 2. Sheath 11 is a cylindrical tubular element having a diameter and length dependent on the wattage and temperature rating of the heater. The heating element, indicated generally at 17, has an electrical resistance wire 18 wound on a flat, rectangular core 19 of mica or other suitable insulating material. Similar flat rectangular sheets of insulating material 20 and 21, one on each side of core 19 and resistance wire winding 18 protect the winding. Return wire 23 extends from the slug end of the heater unit along the outside of cover 21 to the head end of the heater unit. The ends of the heater wire are connected with leads 14, 15 at connectors 25, 26, adjacent the head end of the heater unit 17. A third cover sheet 28 is outside cover sheet 21 and protects return wire 23.

Heater unit centralizer bushings 30 and 31, best seen in FIGS. 7 and 8, are provided at the head and slug ends of heater unit 17. The centralizers are cylindrical in cross-section and the inner face of each has a diametric slot 30*a* 31*a* which receive the head and slug ends, respectively, of heating unit 17. Diametrically spaced, longitudinally extending holes through the head end centralizer 30 receive the leads 14, 15, with connectors 25, 26 inside the body of the centralizer. Slug end centralizer 31 has similar laterally spaced holes or alternatively may have peripheral slots as shown in the '102 patent, through which the sheath is filled with a granular insulating material, as magnesium oxide.

The centralizers 30, 31 may be identical and are shown in more detail in FIGS. 7 and 8. The body of centralizer 30 is cylindrical, with a diametric slot 30*a*. Longitudinal holes 32, 33 are spaced on either side of slot 30(*a*) and receive leads 14, 15 and connectors 25, 26. The centralizers are of a crushable insulating material, as magnesium oxide.

The slug end of sheath 11 is closed by a dished slug 35 welded in the slug end 13 of sheath 11 with the convex surface facing inwardly toward end slug end centralizer 31. The head end of the sheath is closed by a resilient plastic bushing 40 with longitudinal holes (not shown) through which leads 14, 15 extend.

The resistance heater unit is shown in exploded form, FIG. 3, to illustrate its construction. Core 19 and core covers 20, 21 and 28 are all flat, rectangular strips of insulating material, as mica splittings or mica paper. Core 19 is preferably narrower than the core covers. The heater element is a winding 42 of resistance wire 18 on core 19. The resistance wire 18 extends from the first turn 42*a* of winding 42 at the head end through hole 43 in core 19, hole 44 in cover 20 and is secured to lead 15 at connector 26. The second end turn 42*b* of winding 42 at the slug end extends through hole 46 in core 19 and hole 47 in cover 21. Third cover 28 is preferably provided outside cover 21. The return section 23 of resistance wire 18 is laced through axially spaced holes 50, 51 at the slug end of cover 28 and extends between covers 28 and 21 to hole 52 adjacent the head end of cover 28 and then outside the cover 28 to connector 25 and lead 14. This cover arrangement provides protection for the core 19, winding 42 and the return section 23 of the resistance wire during the swaging operation.

The cartridge heater assembly, ready for swaging is shown in FIG. 4. Heater unit 17 is centrally supported within shell 11 between centralizers 30 and 31. The sheath is filled with magnesium oxide which is introduced through longitudinal holes in slug end centralizer 31 or through peripheral slots in the centralizer. The head end 12 of the sheath is closed by plastic bushing 40 and the slug end of the sheath by dished slug 35, welded to the sheath.

The swaging operation is preferably carried out in two steps which may reduce the sheath diameter 0.030" with each step for a total reduction of 0.060". For example, a sheath with an initial diameter of 11/16" is used for a swaged heater having a 5/8" diameter.

The swaging operation results in the assembly shown in FIG. 5. The centralizers 30, 31 are crushed. The surface **40*a* of plastic bushing 40 is bowed outwardly. Dished slug 35 has a more pronounced dish as shown in dashed lines at 35*a*, FIG. 9. The resistance heater unit 17** is undisturbed.

Following swaging, plastic bushing 40 is removed, as by melting. The head end of the sheath 11 is then sealed with a layer of cement 55, FIG. 6. A No. 8 sauereisen cement in a layer 1/8" thick is satisfactory. A silicone waterproofing is preferably applied to the exposed surface **55*a*** of the cement.

The swaged cartridge heater has a higher wattage and temperature rating than an unswaged unit with the same resistance element.

I claim:

1. A cartridge heater assembly to be swaged, comprising:

a cylindrical sheath having a head end and a slug end;

a resistance heater unit in said sheath having a flat rectangular core of insulating material, a resistance wire winding on said core with a first end turn at the head of said core and a second end turn at the slug end of said core, and first and second flat rectangular core covers of insulating material one on each side of said core, in which the resistance wire at said first end turn extends through a hole in the adjacent core cover;

crushable heater unit centralizers at each end of the sheath, holding the resistance heater unit;

a plastic bushing closing the head end of the sheath;

a slug closing the slug end of the sheath; and leads connected to the resistance wire winding and extending from the sheath, the connection between the resistance wire winding and the leads being enclosed in the crushable centralizer at the head end of the sheath with the resistance wires extending from the end turns and connected with said leads.

2. The cartridge heater assembly of claim 1 in which the resistance wire at said first end turn, extends through a hole in said core and then through the hole in said adjacent core cover.

3. A cartridge heater assembly to be swaged, comprising:

a cylindrical sheath having a head end and a slug end;

a resistance heater unit in said sheath having a flat rectangular core of insulating material, a resistance wire winding on said core with a first end turn at the head end of said core and a second end turn at the slug end of said core, and first and second flat rectangular core covers of insulating material one on each side of said core, in which the resistance wire at said second end turn extends through a hole in the adjacent cover and is directed to the head end of the assembly, outside said cover, providing a return spaced from said winding;

crushable heater unit centralizers at each end of the sheath, holding the resistance heater unit;

a plastic bushing closing the head end of the sheath;

a slug closing the slug end of the sheath; and leads connected to the resistance wire winding and extending from the sheath, the connection between the resistance wire winding and the leads being enclosed in the crushable centralizer at the head end of the sheath with the resistance wires extending from the end turns and connected with said leads.

4. The cartridge heater assembly of claim 3 in which the resistance wire extends through a hole in said core and then through the hole in the adjacent cover.

5. The cartridge heater assembly of claim 3 including a third cover outside the heater wire return.

6. The cartridge heater assembly of claim 5 in which the return wire is laced through two holes in said third cover and the return wire is directed to the head end of the assembly between the third cover and the second cover.

7. The method of manufacturing a swaged cartridge heater, comprising:

fabricating a cartridge heater assembly including a cylindrical sheath having head and slug ends, a resistance heater unit in said sheath, the unit having a core, first and second flat rectangular core covers of insulating material, one on each side of the core, a third flat rectangular core cover of insulating material adjacent the second core cover, a resistance wire extending through a hole towards the head end of the core and a hole in the first core cover traveling along the outside of the cover to the head end of the unit, the resistance wire extending through a hole in the slug end of the core and a hole in the second core cover and threaded through two holes in the third adjacent cover traveling between the second and third covers to the head end of the unit, crushable heater unit centralizers, one at each end of the heater unit, each supporting and laterally positioning the heater unit centrally in said sheath, and spaced from contact therewith, and a plastic bushing outside the centralizer at the head of the sheath;

filling said sheath with granular insulation;

closing the slug end of said sheath with a slug; and swaging the sheath, reducing its diameter and crushing the centralizers while maintaining the positioning of the ends of the resistance wire as it travels to the head end of the unit, spaced from the wire winding on the core.

* * * * *